United States Patent [19]

Mauquoy

[11] 4,006,523

[45] Feb. 8, 1977

[54] METHOD OF PRODUCING A PRE-STRESSED BEAM OF STEEL AND CONCRETE

[76] Inventor: Jean-Baptiste Mauquoy, 264 route Provinciale, Bierges lez Wavre, Belgium

[22] Filed: Jan. 21, 1975

[21] Appl. No.: 542,702

[30] Foreign Application Priority Data

Jan. 22, 1974 Belgium ..... 140078

[52] U.S. Cl. ..... 29/452; 29/155 R; 29/460; 52/223 R; 264/228; 425/111

[51] Int. Cl.[2] ..... B28B 23/04

[58] Field of Search ..... 264/228; 425/111; 249/50; 52/223 R; 29/155 R, 452, 460

[56] References Cited

UNITED STATES PATENTS

| | | | |
|---|---|---|---|
| 3,588,971 | 6/1971 | Lipski | 249/50 X |

FOREIGN PATENTS OR APPLICATIONS

| | | | |
|---|---|---|---|
| 1,372,045 | 9/1964 | France | 52/223 R |
| 79,812 | 5/1962 | France | 52/223 R |
| 960,360 | 6/1957 | Germany | 52/223 R |

*Primary Examiner*—Robert F. White
*Assistant Examiner*—Thomas P. Pavelko
*Attorney, Agent, or Firm*—Holman & Stern

[57] ABSTRACT

A method of producing a prestressed beam of steel or steel and concrete having at least one flange in which a plurality of spaced apart transmission elements arranged symmetrically with respect to the center of the span of the beam are secured to the flange, tensioning wires are attached to each two symmetrically disposed transmission elements with the wires extending at predetermined distances from the flange, tensioning the wires to apply to the beam, via the transmission elements, on the one hand solely compressive forces and, on the other hand, in positions corresponding to each transmission element, a bending moment which is opposite to that of the loads to be applied in use, and applying a stress to the beam during the tensioning of the wires substantially to counteract the bending moments. At least one guide element for the wires may be disposed between two symmetrically disposed transmission elements to prevent lateral buckling of the beam during tensioning of the wires. After tensioning the wires, the transmission elements and optionally the flange of the beam are encased in concrete.

5 Claims, 6 Drawing Figures

METHOD OF PRODUCING A PRE-STRESSED BEAM OF STEEL AND CONCRETE

BACKGROUND OF THE INVENTION

This invention relates to a method of producing a beam of steel or steel and concrete having a flange, wherein wires having a high elastic limit are mounted on the flange of the steel beam and tension is applied to the wires in order to subject the beam to an upwardly directed flexion. The assembly comprising the flexed beam and tensioned wires may be encased in concrete.

In methods currently employed for producing compressive forces in concrete encasing the portion of the beam which will be subjected to tensile forces under operating stresses, the starting point is a metal beam which by itself must be able to withstand the flexion. Compression in the encasing concrete is obtained by eliminating initial preflexion which was maintained during the setting of the concrete; however, this preflexion gives rise to tensile forces in the encased metal part and therefore produces tensions which are already in the same direction as those which will be produced by operating loads.

SUMMARY OF THE INVENTION

The present invention aims at obviating these disadvantages and to this end consists in a method of producing a prestressed beam of steel have a flange, which comprises securing to the flange a plurality of spaced apart transmission elements arranged symmetrically in relation to the center of the span of the beam, attaching tensioning wires to each two symmetrically disposed transmission elements so that the respective wires extend at predetermined distances from the flange, and tensioning the wires so as to apply to the beam via the transmission elements on the one hand solely compressive forces and on the other hand, in positions corresponding to each transmission element, a bending moment which is oppositely directed to that of the operating loads to be applied to the beam, a stress being applied to the beam during the tensioning of the wires which substantially counteracts the bending moments.

By means of the transmission elements it is possible to transmit to the beam, at the places where these elements are fixed, moments which are equivalent and oppositely directed to the moments due to the operating loads at these places and which are exactly adapted to the values and distribution of the operating loads. Since the beam itself has to withstand only simple compressive forces (it will be shown that an optional feature of the invention obviates any danger of the buckling of the beam under the compressive forces transmitted to it) it may have a greatly reduced section. Furthermore, because of the great height which will generally be given to these transmission elements, it will be possible to obtain the desired bending moment with minimum tensile force in the wires. This results in a saving of wires, and also yet a further reduction of the section of the beam, which has to withstand only compressive forces which are lower, the lower the tensile forces in the wires.

In known methods of applying tensile forces to wires supported on the bottom flange of the beam, a limitation is imposed by the lateral buckling of the beam. Since the width of the bottom flange of the beam is very slight in comparison with spans, the danger of buckling soon appears and limits the compressive forces which the wires can transmit. An optional feature of the present invention obviates all danger of buckling. To this end the procedure comprises fixing guide elements to the lower face of the bottom flange of the beam, in addition to the previously mentioned transmission elements. These guide elements are rigid metal sections of great height (their height being equal to or slightly greater than the height of the transmission elements), and are fixed firmly to the bottom flange. These guide elements are placed between the transmission elements, the number of guide elements so disposed being such that the distance between two of these elements, or between a transmission element and a guide element, is sufficiently short to obviate any danger of the buckling of the bottom flange of the beam. These guide elements act in the following manner: the system of tensioning the wires by displacement of points of the trajectory produces perfectly symmetrical forces in these wires. These wires are fixed to the guide elements at the ends of the latter.

These fastening points of the wires are the points of the trajectory of the latter which are held at the greatest distance from the bending plane. The tension in the wires gives rise to a component which holds the guide elements fastened to them in the bending plane, and therefore likewise holds the flange of the beam fixed to these guide elements.

A beam constructed in accordance with the method of the invention comprises the following elements:

1. A rigid metal part. This is formed by an ordinary beam, by an assembly of sections, or else a composite arrangement of sections and reinforced or non-reinforced concrete. In the following particular description, this concrete, when used, will be referred to as concrete 1.

2. Wires having a very high elastic limit and breaking strength, or wire strands.

3. Elements which will be called "transmission elements." These are composed of an assembly of metal sections and wide flats, optionally encased in concrete.

The important characteristics of these elements are:

a. Their height (of the same order of magnitude as the height of the beam).

b. Their connection to the beam. This connection must be sufficient to ensure that the transmission element can transmit to the metal part a compressive force equal to the tensile force to which the wires are subjected, and a very great bending moment. This bending moment is of the same order of magnitude as that produced by the operating loads at the place where the transmission element is fixed.

One practical means of fastening the transmission elements is electric arc welding.

4. Elements which will be called "guide elements." These have two functions:

a. Preventing the lateral buckling of the beam under the very great compression transmitted by the transmission elements. For this purpose the guide elements are rigidly fastened to the metal part and the symmetrical forces to which the wires are subjected are such that they keep the center of gravity of the guide elements, and consequently of the metal part rigidly joined to them, in the bending plane.

b. In the bending plane, the fastening of the wires or wire strands at the optimum height in relation to the center of gravity of the beam. This is done in such a way as to adapt the forces transmitted by the wires to the stresses of the operating loads.

5. Reinforced or non-reinforced concrete encasing the wires or wire strands and optionally the bottom portion of the metal part. Hereinafter this concrete will be referred to as concrete 2.

BRIEF DESCRIPTION OF THE DRAWINGS

In order that the invention may be more readily understood, reference is made to the accompanying drawings which illustrate diagrammatically and by way of example embodiments thereof, and in which.

DESCRIPTION OF PREFERRED EMBODIMENT

Figure 1:
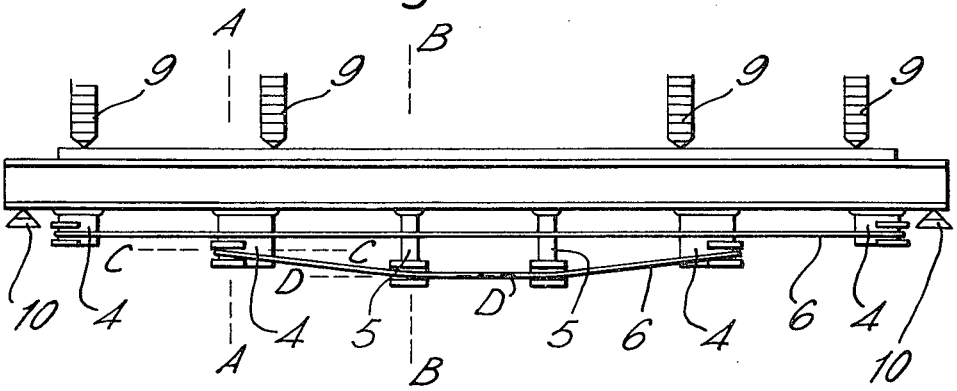
FIG. 1 is an elevation view of a beam before the setting of the concrete.
Figure 2:
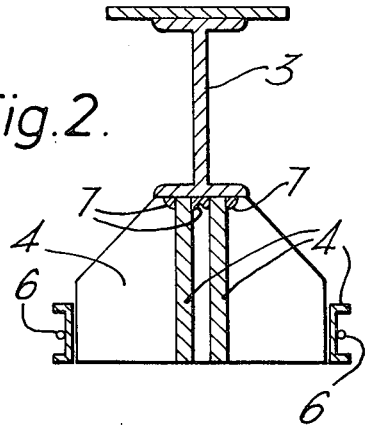
FIG. 2 is an enlarged vertical sectional view taken along the line A—A of FIG. 1.
Figure 3:
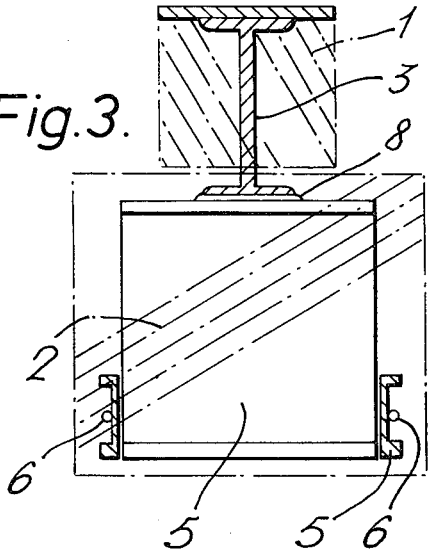
FIG. 3 is an enlarged vertical sectional view taken along the line B—B of FIG. 1.
Figure 4:
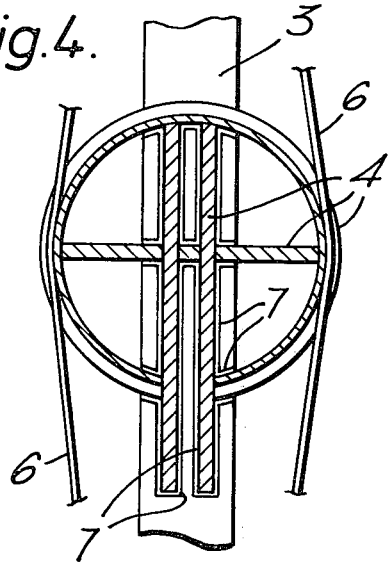
FIG. 4 is an enlarged horizontal sectional view taken along the line C—C of FIG. 1.
Figure 5:
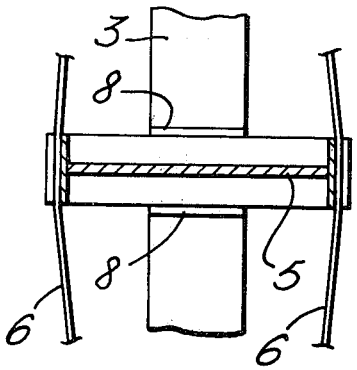
FIG. 5 is an enlarged horizontal sectional view taken along the line D—D of FIG. 1.
Figure 6:
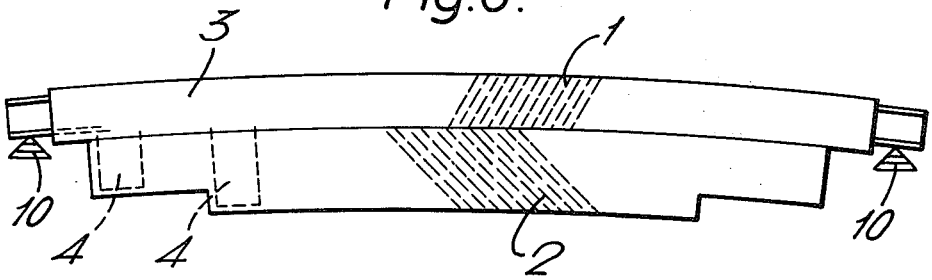
FIG. 6 is an elevation view of a beam after the setting of the concrete and removal of the means for preventing deformation under the bending moments.

In the different Figures, the same reference numerals are used to designate identical elements.

In the method of producing the prestressed beam of the invention the procedure is as follows:

1. The concrete 1 is poured and allowed to set. This concrete 1, however, is not indispensable, but it makes possible a saving of steel in the metal part 3 of the beam. During the construction of the beam, the metal part 3 supported by devices 10 has in fact to withstand only compressive forces, and it is generally more advantageous to use concrete to withstand these forces.

2. The transmission elements 4 are fastened at 7 to the metal part by means of welding. There is an even number of these parts, the number varying in each particular case. They are disposed symmetrically in relation to the center of the span.

3. The guide elements 5 are fastened at 8 to the metal part by welding. It should be observed that the flexibility of the method is such that these transmission elements and guide elements may be placed not only on the bottom portion of the beam, as will usually be the case, but also on the top portion in order to prestress continuous or cantilever beams.

4. The wires 6 or wire strands are placed in position. These are fastened to the transmission and guide elements.

5. The beam thus equipped is placed against counter supports 9.

6. The support devices 10 are placed in position.

7. The required tensile forces are applied to the wires or wire strands in the conventional manner.

8. The encasing concrete (concrete 2) is poured.

9. When the encasing concrete has set, the support devices are removed, and the finished beam is thus obtained.

These various operations entail the following considerations:

1. It is advantageous to give the various elements the metal part, (transmission elements and the guide elements) heights of the same order of magnitude and to calculate their sections so that the neutral axis of the whole arrangement is situated at a very short distance from the bottom portion of the metal part. In this way, when the wires or wire strands are tensioned it will be possible to compress the metal portion up to about the breaking load by simple compression, since at that moment the metal portion will be subjected to maximum stresses temporarily (until the supporting devices are removed) with due regard to the action of the guide elements which eliminate any danger of buckling.

2. Removal of the supporting devices is solely equivalent to subjecting the beam to vertical forces in the opposite direction to the operating loads. Consequently:

a. the stressing of the upper portion of the metal part changes from the original compressive stressing to tensile stressing (the first desired aim).

b. the stressing of the lower portion of the metal part varies very little because of its proximity to the neutral axis at that moment. Moreover, the various elements of the beam may be so proportioned that the neutral axis is slightly below the bottom portion of the metal part, so that the variation of tension consists of a slight reduction of compression.

3. The upper flange of the metal part is first compressed to about the limit permitted under simple compression. Through the action of the moment produced by the elimination of the transverse stresses, this upper flange is then subjected to tension. This tensile stress may also be as high as the tensile limit of the steel.

4. The bottom flange of the metal part is compressed under the same conditions as the upper flange. This compression constitutes the maximum stressing which this portion of the beam will ever undergo. Its immediate proximity to the neutral axis has in fact the consequence that the different bending moments introduced subsequently, during construction and under operating loads, have practically no effect on this portion of the beam.

5. Under the action of the moments due to operating loads the metal part is subjected to maximum stresses, which pass from negative maxima to positive maxima. This constitutes an enormous economic advantage over previous processes in which the stresses vary from zero to maximum stresses.

7. It should be observed that the process includes the following economic advantage: the metal part does not have to be capable of withstanding the bending by itself. This bending is taken by the transmission elements associated with the metal part, and this is done solely over the length of the transmission elements. This means that over from 80% to 90% of the span the section of the metal part may be considerably reduced, since by itself it will have to withstand only the simple compressive forces without any risk of buckling because of the fastening of the guide elements to this metal part.

7. Another advantage results from the following consideration: when the wires or wire strands are subjected to tension, the bending moment introduced into the metal part by the guide elements has a very long lever arm because at this time (without the concrete 2) the neutral axis is situated at a great height. When the beam is put into use (the concrete 2 having set) this lever arm is considerably displaced in the downward direction. The tensile forces resulting therefrom are reduced proportionally.

8. The encasing concrete is compressed solely through the stressing of the moment introduced by the elimination of the supporting forces, because the longitudinal compression forces have previously been balanced by the metal part alone.

This moment is of the same order of magnitude as the moment due to operating loads. It may even be made slightly greater than the latter moment. In this way the encasing concrete will always be compressed under the operating loads, which is another important desired aim.

I claim:

1. A method of producing a prestressed beam of steel having a flange, which comprises the steps of: securing to the flange a plurality of spaced apart transmission elements; attaching at least one tensioning wire to the transmission elements, each wire being attached to two of the transmission elements so that the respective wires extend at predetermined distances from the flange; tensioning the at least one wire so as to apply to the beam via the transmission elements in positions corresponding to each transmission element, a bending moment which is oppositely directed to that of the operating loads to be applied to the beam, and applying a stress to the beam during the tensioning of the at least one wire which substantially counteracts the bending moments, in order to create solely compressive forces in the beam; encasing the at least one wire, the transmission elements and the flange in concrete while maintaining the tensioning; and after the concrete has set, freeing the beam of the stresses counteracting the bending moments due to the tensioning of the at least one wire to allow the beam of steel to bend.

2. The method as claimed in claim 1, further comprising the step of: before tensioning the at least one wire, securing to the flange, between at least two symmetrically disposed transmission elements, at least one guide element which transversely and symmetrically to the bending plane of the beam spaces apart the tensioning wires which, by virtue of the tensioning, hold the guide element in this bending plane so that the guide element, by virtue of its fastening to the beam, prevents lateral buckling of the beam.

3. The method as claimed in claim 1, further comprising the step of: encasing the beam except for the flange in non-reinforced concrete prior to securing the transmission elements.

4. The method as claimed in claim 1, further comprising the step of: encasing the beam except for the flange in reinforced concrete prior to securing the transmission elements.

5. The method as claimed in claim 1, wherein the spaced apart transmission elements are arranged symmetrically in relation to the center of the span of the beam.

* * * * *